US005914226A

United States Patent [19]

Lok

[11] Patent Number: 5,914,226

[45] **Date of Patent: *Jun. 22, 1999**

[54] SILVER HALIDE EMULSIONS WITH IMPROVED HEAT STABILITY

[75] Inventor: Roger Lok, Rochester, N.Y.

[73] Assignee: Eastman Kodak Company, Rochester, N.Y.

[ * ] Notice: This patent is subject to a terminal disclaimer.

[21] Appl. No.: 08/927,866

[22] Filed: Sep. 11, 1997

[51] Int. Cl.[6] ..... G03C 1/09

[52] U.S. Cl. ..... 430/567; 430/569; 430/603; 430/611

[58] Field of Search ..... 430/603, 611, 430/567, 569

[56] References Cited

U.S. PATENT DOCUMENTS

| | | | |
|---|---|---|---|
| 2,440,110 | 4/1948 | Mueller | 430/607 |
| 3,144,336 | 8/1964 | Herz | 430/608 |
| 4,699,873 | 10/1987 | Tukahashi et al. | 430/446 |
| 5,003,097 | 3/1991 | Beaucage et al. | 536/25.32 |
| 5,116,723 | 5/1992 | Kajiwara et al. | 430/611 |
| 5,219,721 | 6/1993 | Klaus et al. | 430/569 |
| 5,292,635 | 3/1994 | Lok | 430/611 |
| 5,328,820 | 7/1994 | Klaus et al. | 430/569 |
| 5,356,770 | 10/1994 | Lok et al. | 430/611 |
| 5,411,855 | 5/1995 | MacIntyre et al. | 430/603 |
| 5,556,741 | 9/1996 | Suga et al. | 430/569 |
| 5,670,307 | 9/1997 | Lok | 430/611 |
| 5,677,119 | 10/1997 | Lok | 430/600 |
| 5,693,460 | 12/1997 | Lok | 430/611 |

FOREIGN PATENT DOCUMENTS

| | | | |
|---|---|---|---|
| 0 447 105 | 9/1991 | European Pat. Off. | G03C 1/34 |
| 3208041 | 9/1991 | Japan | G03C 1/035 |
| 1147697 | 4/1969 | United Kingdom | G03C 1/08 |

OTHER PUBLICATIONS

Japanese Patent Abstract 4,019,736, Jan. 23, 1992.

*OPPI Briefs*, vol. 24, No. 4, pp. 488–492, (1992).

*Primary Examiner*—Mark F. Huff
*Attorney, Agent, or Firm*—Sarah Meeks Roberts

[57] ABSTRACT

A silver halide photographic element comprising a silver halide emulsion which is greater than 50 mole % silver chloride, said emulsion being in reactive association with a dithiolone 1-oxide compound represented by the following formula:

wherein b is C(O), C(S), C(Se), $CH_2$ or $(CH_2)_2$, and $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system; and a sulfinate compound.

20 Claims, No Drawings

SILVER HALIDE EMULSIONS WITH IMPROVED HEAT STABILITY

FIELD OF THE INVENTION

This invention relates to color silver halide photographic elements which contain a dithiolone 1-oxide compound and a sulfinate compound. These elements exhibit improved storage stability and reduced sensitivity to high temperatures during exposure.

BACKGROUND OF THE INVENTION

Color photographic elements commonly employ silver halide emulsions, with the halide content being dependent on the intended use of the product. In photofinishing processes which use photosensitive paper to produce color prints it is generally desirable to shorten the processing time. One way to shorten the processing time is to accelerate the development rate of the photosensitive paper by increasing the chloride content of the silver halide emulsions, i.e., the higher the chloride content, the faster the development rate.

However, it is often difficult to obtain high, invariant photosensitivity with high chloride emulsions. Typically, high chloride emulsions experience greater fog and emulsion sensitivity changes when stored under high temperature and/or humidity conditions than do low chloride emulsions. The increase in fog and the emulsion sensitivity changes may vary from layer to layer in a photographic element causing increased color imbalance and a loss of quality in the printed material.

The control of fog, whether occurring during the formation of the light-sensitive silver halide emulsion, during the spectral/chemical sensitization of the emulsions, during the preparation of the silver halide compositions prior to coating, or during the aging of such coated silver halide compositions, has been attempted by a variety of means. Thiosulfonates and thiosulfonate esters, such as those described in U.S. Pat. Nos. 2,440,206; 2,934,198; 3,047,393; and 4,960,689 have been used as additives to control fog. Organic dichalcogenides, for example the disulfide compounds described in U.S. Pat. Nos. 1,962,133; 2,440,110; 2,465,149; 2,756,145; 2,866,036; 2,935,404; 2,948,614; 3,043,696; 3,057,725; 3,148,313, 3,226,232; 3,318,701; 3,409,437; 3,447,925; 3,397,986; 3,761,277; 4,243,748; 4,463,082; and 4,788,132 have been used not only to prevent formation of fog but also as desensitizers and as agents in processing baths and as additives in diffusion transfer elements. However, disulfides which inhibit fog formation can also reduce emulsion sensitivity. Organic compounds having a polysulfur linkage comprised of three or more sulfur atoms, and organic compounds having a heterocyclic ring having at least two thioether linkages or at least one disulfur linkage, such as those described in U.S. Pat. No. 5,116,723, have been discussed as suppressing fog and improving raw stock stability when used in combination with nitrogen-containing cyclic compounds.

Photographic elements with a high silver chloride content are also more sensitive to high temperatures during exposure. For example, when the temperature upon exposure rises, i.e., owing to heat from a lamp or the like during printing, the print density changes if the printing conditions are not adjusted to compensate for the rise in temperature. Additionally, an increase in temperature during exposure of the paper often results in a selective increase in speed in one light sensitive layer over another light sensitive layer thereby resulting in an improper color balance in the color print. The photofinishing process must then be adjusted to compensate for this density fluctuation, causing a decrease in efficiency.

Sulfinates have been used for a variety of purposes in photographic elements. They have been described, for example, as storage stability improving compounds in color photographs in U.S. Pat. No. 4,939,072; as anti-staining agents in U.S. Pat. No. 4,770,987; as stabilizers in a direct positive photographic material in U.S. Pat. No. 3,466,173 and as antifoggants in U.S. Pat. No. 2,057,764.

Sulfinates have also been used in combination with other compounds for improving speed and stability in a silver halide photographic element, for example, they have been described for use in combination with thiosulfonate salts and an amine borane in U.S. Pat. No. 5,411,855 and in combination with thiosulfonates and an alkynylamine in U.S. Pat. No. 5,399,479. Sulfinates have also been used, for example, in combination with diamino disulfides to improve storage stability and to reduce high temperature sensitivity during exposure in a silver halide photographic element as described in U.S. Pat. No. 5,356,770; in combination with thiosulfonates to control speed increase on incubation of color photographic materials as described in U.S. Pat. No. 5,292,635; in combination with iodate ions to prevent yellow fog in silver halide materials as described in U.S. Pat. No. 3,615,534; in combination with thiosulfonates for the sensitization of chloride emulsions for color paper as described in JP 3,208,041 and for stabilizing silver halide emulsions as described in U.S. Pat. No. 2,394,198; in combination with labile sulfur compounds in the sensitization of silver halide emulsions as described in U.S. Pat. No. 3,144,336; in combination with small amounts of polythionic acids to stabilize photographic emulsions against fog growth as described in U.S. Pat. No. 2,440,206; and in combination with aromatic or heterocyclic polysulfides in controlling fog growth as described in U.S. Pat. No. 2,440,110.

A need still exists for a method of stabilizing silver halide emulsions against fogging without reducing the sensitivity of the emulsions, thereby preventing a loss in photographic speed. A need also exists for a method of reducing the sensitivity of high chloride emulsions to temperature changes during exposure.

SUMMARY OF THE INVENTION

This invention provides a silver halide photographic element comprising a silver halide emulsion which is greater than 50 mole % silver chloride, said emulsion being in reactive association with a dithiolone 1-oxide compound represented by the following formula:

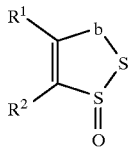

wherein b is C(O), C(S), C(Se), $CH_2$ or $(CH_2)_2$, and $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system; and a sulfinate compound.

The photographic elements of this invention employ silver chloride emulsions which exhibit improved storage stability and/or reduced high temperature sensitivity during exposure. The improvement in storage stability and high temperature sensitivity is gained without causing a loss in photographic speed as a result of a reduction in the emulsion sensitivity.

DETAILED DESCRIPTION OF THE INVENTION

Applicants have surprisingly determined that color photographic materials employing a silver chloride emulsion containing a combination of certain dithiolone compounds and a sulfinate compound exhibit improved storage stability and a reduced sensitivity to high temperatures during exposure.

The compounds of this invention are dithiolone 1-oxide compounds represented by the following Formula I:

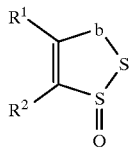

wherein b is C(O), C(S), C(Se), $CH_2$ or $(CH_2)_2$. More preferably b is C(O), C(S) or C(Se) and most preferably b is C(O).

$R^1$ and $R^2$ can be any substituents which are suitable for use in a silver halide photographic element and which do not interfere with the stabilizing activity of the dithiolone 1-oxide compound. $R^1$ and $R^2$ may be independently H, or a substituted or unsubstituted aliphatic, aromatic, or heterocyclic group or $R^1$ and $R^2$ may together represent the atoms necessary to form a ring or a multiple ring system. $R^1$ and $R^2$ may also be alkoxy groups (for example, methoxy, ethoxy, octyloxy), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acyloxy groups (for example, acetoxy, benzoxy), carboxyl groups, cyano groups, sulfo groups, and amino groups.

When $R^1$ and $R^2$ are aliphatic groups, preferably, they are alkyl groups having from 1 to 22 carbon atoms, or alkenyl or alkynyl groups having from 2 to 22 carbon atoms. More preferably, they are alkyl groups having 1 to 8 carbon atoms, or alkenyl or alkynyl groups having 3 to 5 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms. More preferably, the aromatic groups have 6 to 10 carbon atoms and include, among others, phenyl and naphthyl groups. These groups may have substituent groups. The heterocyclic groups are 3 to 15-membered rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Preferably, $R^1$ and $R^2$ together form a ring or multiple ring system. These ring systems may be unsubstituted or substituted. The ring and multiple ring systems formed by $R^1$ and $R^2$ may be alicyclic or they may be the aromatic and heterocyclic groups described above. In a preferred embodiment, $R^1$ and $R^2$ together form a 5 or 6-membered ring, preferably, an aromatic ring. In one particularly preferred embodiment b is C(O) and $R^1$ and $R^2$ together form a 5 or 6-membered ring. Most preferably, the dithiolone 1-oxide compound is 3H-1,2-benzodithiol-3-one 1-oxide.

Nonlimiting examples of substituent groups for $R^1$ and $R^2$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 4 carbon atoms (for example, methyl) and halogen groups (for example, chloro). Specific examples of the dithiol 1-oxide compounds include, but are not limited to:

1

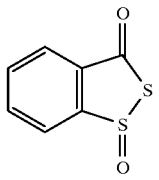

2

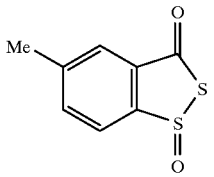

3

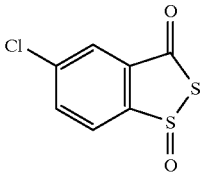

4

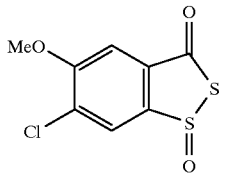

-continued
5
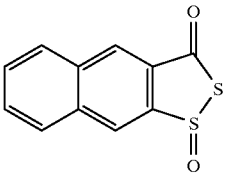
6
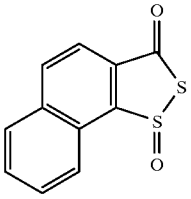
7
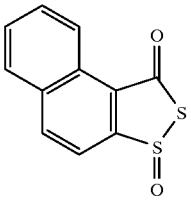
8
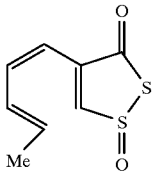
9
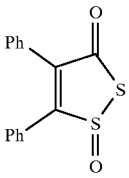
10
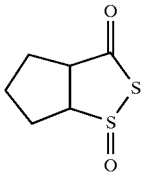
11
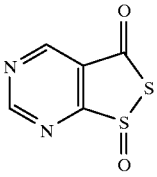
-continued
12
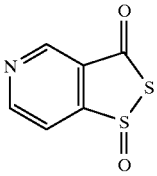
13
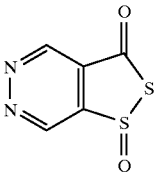
14
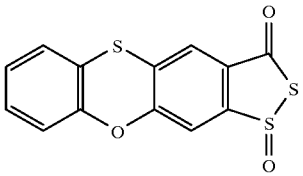
15
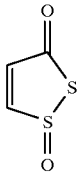
16
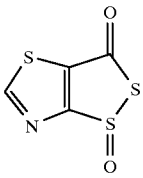
17
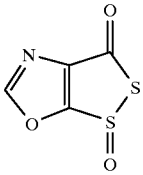
18
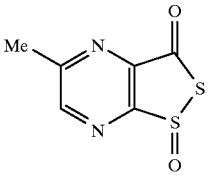
19
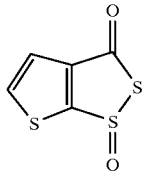

-continued

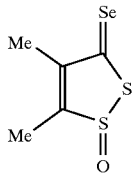

21

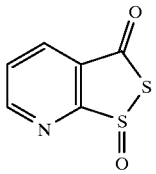

22

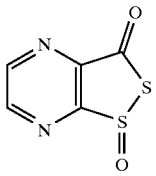

23

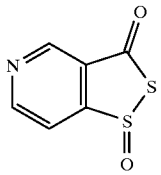

24

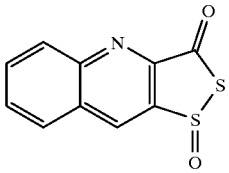

25

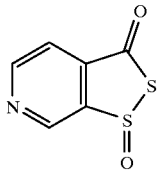

26

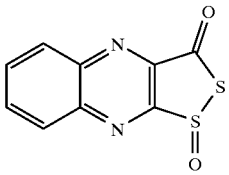

27

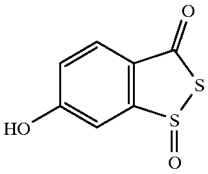

-continued

28

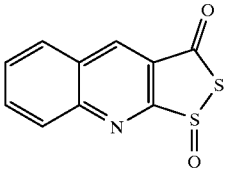

29

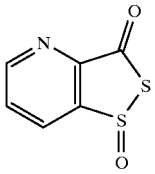

30

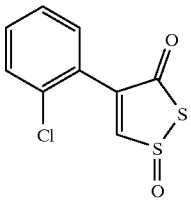

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Examples of suitable substituents are those as described for $R^1$ and $R^2$.

One method of preparing an aromatic dithiol 1-oxide is via the cyclization of an ortho substituted aryl mercaptocarboxylic acid in the presence of thiolacetic acid. This is followed by the oxidation of the product with hydrogen peroxide as described in *J. Org. Chem.,* Vol. 55, 4693 (1990) incorporated herein by reference.

Useful levels of the dithiolone 1-oxide compounds range from 0.01 mg to 10,000 mg per silver mole. The preferred range is from 0.1 mg to 5,000 mg per silver mole with a more preferred range being from 1.0 mg to 1,000 mg per silver mole. The most preferred range is from 10 mg to 100 mg per silver mole.

The dithiolone compounds may be added to the photographic emulsion using any technique suitable for this purpose. They may be dissolved in most common organic solvents, for example, methanol or acetone. The dithiolone 1-oxide compounds can be added to the emulsion in the form of a liquid/liquid dispersion similar to the technique used with certain couplers. They can also be added as a solid particle dispersion.

The sulfinate compound is preferably of the formula $RSO_2M$ wherein R is selected from the group consisting of substituted or unsubstituted alkyl, aryl, or arylalkyl groups. Preferably, the aryl group is a six-membered ring. Substituted aryl groups may contain one or more substituents, preferably selected from the group consisting of alkyl, alkoxy and halogen. Particularly preferred substituents for the aryl group comprise alkyl and alkoxy groups containing from 1 to about 6 carbon atoms. When R is an alkyl group it preferably contains contains from 1 to about 22 carbon atoms and more preferably from 1 to about 3 carbon atoms. M represents a monovalent metal or a tetraalkylammonium cation. Preferred monovalent metals for use in the sulfinate compound are sodium and potassium, with sodium being particularly preferred.

The sulfinate compounds are commercially available or they may be produced by reduction of the corresponding sulfonyl chlorides in accordance with methods well known in the art. Preferred sulfinates include, but are not limited to, sodium phenyl sulfinate, sodium p-toluene sulfinate, sodium p-anisole sulfinate and sodium ethyl sulfinate. Sodium p-toluene sulfinate (Compound IIC) is a particularly preferred sulfinate for use in the present materials and methods.

The suitable range of the sulfinate compound may be from 0.01 to 10,000 mg per silver mole. A preferred range is from 0.1 mg to 1000 mg per silver mole. A more preferred range is from 1 mg to 100 mg per silver mole. The most preferred range is from 10 mg to 50 mg/Ag mole. The sulfinate compounds may be added to the photographic emulsion using any technique suitable for this purpose. Sulfinate salts are most conveniently dissolved in water. The ratio of the dithiolone compound to the sulfinate compound may be anywhere from 1:0.1 to 1:20 by weight.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The dithiolone and sulfinate compounds may be added to the silver halide emulsion at any time during the preparation of the emulsion, i.e., during precipitation, during or before chemical sensitization or during final melting and co-mixing of the emulsion and additives for coating. More preferably, these compounds are added during or after chemical sensitization, and most preferably during. It is preferred that the sulfinate and dithiolone compounds be added separately. It is more preferred that the sulfinates be added prior to the dithiolone compounds. It is most preferred that the sulfinates be added just before the introduction of the dithiolone compounds.

The dithiolone and sulfinate compounds may be added to any layer where they are in reactive association with the silver halide. By "in reactive association with" it is meant that the compounds must be contained in the silver halide emulsion layer or in a layer whereby they can react or interact with, or come in contact with the silver halide emulsion. For example, the compounds can also be added to gelatin-only overcoats or interlayers.

The dithiolone and sulfinate compounds may be used in addition to any conventional emulsion stabilizer or antifoggant as commonly practiced in the art. Combinations of more than one dithiolone compound or one sulfinate compound may be utilized.

The silver halide emulsions utilized in this invention are predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic emulsions incorporating the stabilizers may be incorporated into color negative (particularly color paper) or reversal photographic elements. The photographic element may also comprise a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, (3) *Research Disclosure,* September 1994, Item 36544, and (4) *Research Disclosure,* September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | V | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII,IX C &D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

The following examples illustrate the practice of the invention. They are intended to be illustrative, and should not be construed as limiting the invention to the specific embodiments disclosed.

EXAMPLES

Example 1

In accordance with the present invention, a 0.3 mol of an negative silver iodochloride emulsion (0.2% iodide introduced in the course of the precipitation of the emulsion at 90% of total silver added) was sensitized with a colloidal suspension of aurous sulfide (2.73 mg/Ag mol) at 40° C. The emulsion was heated to 60° C. at a rate of 10° C. per 6 minutes and then held at this temperature for 37 minutes. During this time, a blue spectral sensitizing dye, anhydro-5-chloro-3,3'-di(3-sulfopropyl)-5'-(1-pyrrolyl)-thiazolothiacyanine hydroxide triethylammonium salt (200 mg/Ag mol),), a suspension of Lippman bromide (357 mg/Ag mol), 1-(3-acetamidophenyl)-5-mercaptotetrazole (91.48 mg/Ag mol), and compounds IIc and 1 in amounts indicated in Table 1 were added. The emulsion was cooled back to 40° C. at a rate of 10° C. per 6 minutes. This emulsion further contained a yellow dye-forming coupler alpha-(4-(4-benzyloxy-phenyl-sulfonyl)phenoxy)-alpha (pivalyl)-2-chloro-5-(gamma-(2,4-di-5-amylphenoxy) butyramido)acetanilide (1.08 g/m$^2$) in di-n-butylphthalate coupler solvent (0.27 g/m$^2$), gelatin (1.51 g/m$^2$). The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight.

The coatings were given a 0.1 second exposure, using a 0–3 step tablet (0.15 increments) with a tunsten lamp designed to stimulate a color negative print exposure source. This lamp had a color temperature of 3000K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| | |
|---|---|
| Developer: | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |
| Bleach-fix | |
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

The data in Table I show the changes in fog density of the blue sensitized coatings after a one and two week storage at 120° F. relative to those kept at 0° F. Fog was measured as the minimum density (Dmin) above zero. The speed taken at the 1.0 density point of the D log E curve was taken as a measure of the sensitivity of the emulsion. Heat sensitivity data was obtained on a sensitometer which was modified with a water jacket so that the temperature of the step tablet could be maintained at 22° C., or increased to 40° C. The change in speed due to the temperature variation was also calculated at the 1.0 density point.

TABLE I

| | mg Ag mol | | Fresh | 1 week 120 vs 0° F. | | 2 week 120 vs 0° F. | | Heat Sensitivity 22 vs 40° C. |
|---|---|---|---|---|---|---|---|---|
| Sample | 1 | IIc | SPEED | Δ SPEED | Δ DMIN | Δ SPEED | Δ DMIN | Δ SPEED |
| 1 (comparison) | 0 | 0 | 185 | 10.8 | 0.061 | 27.5 | 0.259 | 4.103 |
| 2 (comparison) | 0 | 180 | 186 | 11.6 | 0.067 | 26.4 | 0.259 | 2.988 |
| 3 (comparison) | 1.84 | 0 | 174 | 10.9 | 0.056 | 26.2 | 0.216 | 0.017 |
| 4 (comparison) | 5.52 | 0 | 170 | 9.8 | 0.052 | 20.8 | 0.195 | −2.650 |
| 5 (comparison) | 11.04 | 0 | 162 | 7.8 | 0.043 | 24.7 | 0.185 | −5.184 |
| 6 (comparison) | 16.56 | 0 | 156 | 7.7 | 0.031 | 21.2 | 0.144 | −5.654 |
| 7 (invention) | 1.84 | 18.4 | 183 | 8.6 | 0.044 | 20.3 | 0.167 | 2.952 |
| 8 (invention) | 5.52 | 55.2 | 182 | 7.7 | 0.039 | 12.4 | 0.104 | 1.385 |
| 9 (invention) | 11.04 | 110.4 | 183 | 5.3 | 0.021 | 10.2 | 0.062 | −0.102 |
| 10 (invention) | 16.56 | 165.6 | 181 | 3.6 | 0.012 | 7.8 | 0.041 | −0.720 |

It can be seen in Table I that samples of the present invention (7–10) have reduced fog growth compared to the control (sample 1) that does not have the compounds of the present invention or to sample #2 that contains only compound IIC. Additionally, samples #9 and 10 have a heat sensitivity reduction benefit as well as reduction in fog growth. It is also clear that the inventive samples (7–10) having a ratio of 1:10 of the dithiolone oxide to sulfinate have higher speed than the comparison samples (2–7) that do not have any sulfinate.

Example 2

In another practice of the invention, the same negative silver chloride emulsion was similarly sensitized with a colloidal suspension of aurous sulfide at 40° C. as for Example 1, except that p-glutaramidophenyl disulfide (10 mg/Ag mol) was added prior to addition of the aurous sulfide dispersion. Compound IIC was used at five times excess of Compound 1 by weight as indicated in Table 2. KBr and 1-(3-acetamidophenyl)-5-mercaptotetrazole were added as in Example 1. The emulsion was heated to 57.2° C. at a rate of 10° C. per 6 minutes, held at this temperature for 40 minutes and then cooled to 40° C. The emulsion was similarly doctored, coated, exposed and processed as for Example 1.

TABLE II

| | mg Ag mol | | Fresh | 1 week 120 vs 0° F. | | 2 week 120 vs 0° F. | | Heat Sensitivity 22 vs 40° C. |
|---|---|---|---|---|---|---|---|---|
| Sample | 1 | IIc | SPEED | Δ SPEED | Δ DMIN | Δ SPEED | Δ DMIN | Δ SPEED |
| 11 (comparison) | 0 | 0 | 157 | 45.8 | 0.597 | im | 1.404 | 1.7 |
| 12 (comparison) | 0 | 250 | 157 | 40.0 | 0.412 | im | 1.135 | 1 |
| 13 (comparison) | 0 | 500 | 157 | 40.3 | 0.446 | im | 1.153 | 0.5 |
| 14 (comparison) | 4 | 0 | 155 | 36.4 | 0.332 | im | 1.194 | 0.5 |
| 15 (comparison) | 8 | 0 | 150 | 25.9 | 0.132 | 66.0 | 0.776 | −3.2 |
| 16 (comparison) | 12 | 0 | 146 | 22.3 | 0.098 | 62.4 | 0.753 | −3.7 |
| 17 (comparison) | 18 | 0 | 138 | 17.6 | 0.034 | 38.0 | 0.421 | −6.4 |
| 18 (comparison) | 24 | 0 | 134 | 13.8 | 0.017 | 31.9 | 0.234 | −7 |
| 19 (comparison) | 30 | 0 | 131 | 14.9 | 0.014 | 35.3 | 0.237 | −6.6 |
| 20 (comparison) | 50 | 0 | 113 | 12.2 | −0.001 | 25.5 | 0.060 | −11.7 |
| 21 (invention) | 4 | 20 | 156 | 29.9 | 0.217 | 70.9 | 0.823 | −1.4 |
| 22 (invention) | 8 | 40 | 154 | 21.9 | 0.128 | 47.3 | 0.589 | −0.9 |
| 23 (invention) | 12 | 60 | 153 | 17.9 | 0.095 | 39.6 | 0.460 | −3 |
| 24 (invention) | 18 | 90 | 152 | 12.5 | 0.051 | 27.7 | 0.282 | −0.9 |
| 25 (invention) | 24 | 120 | 152 | 7.8 | 0.026 | 20.8 | 0.144 | −2.6 |
| 26 (invention) | 30 | 150 | 150 | 6.9 | 0.013 | 16.4 | 0.099 | −1.9 |
| 27 (invention) | 50 | 250 | 146 | 4.0 | 0.001 | 10.1 | 0.036 | −3.5 |

The data in Table II show that samples (21–27) containing the combination of 1 and IIC show a reduced fog level compared to the coating (sample 11) without 1 or the coatings (samples 12 and 13) containing only IIC. While samples (14–20) containing only compound 1 have reduced fog growth, the sensitivity (speed) of these coatings are reduced compared to those in samples (21–27) of the present invention. The heat sensitivity for sample #24 of the present invention is similar to the control (sample 12), but without being driven to the negative direction as in sample 18 or 19 which have about the same fog level after a two-week storage but both having only compound 1 present. It is also clear that in this example, a reduced ratio of 1:5 of the dithiolone oxide to sulfinate relative to Example 1 has desired activity as in the previous example.

Example 3

A 0.3 mol of an negative silver iodochloride emulsion (0.5% iodide introduced in the course of the precipitation of the emulsion at 93% of total silver added) was sensitized with a colloidal suspension of aurous sulfide (27.93 mg/Ag mol) at 40° C. The emulsion was heated to 55° C. at a rate of 10° C. per 6 minutes and then held at this temperature for 63 minutes. During this time, a green spectral sensitizing dye, 5-chloro-2-[2-[[5-phenyl-3-(3-sulfobutyl)-2(3H)-benzoxazolylidene]methyl]- 1-butenyl]-3-(3-sulfopropyl)-benzoxazolium sodium salt(453.13 mg/Ag mol),), 1-(3-acetamidophenyl)-5-mercaptotetrazole (68.61 mg/Ag mol), compounds IIc and 1 in amounts indicated in Table 3 were added. The emulsion was cooled to 40° C. at a rate of 10° C. per 6 minutes. This emulsion was mixed further with a green dye-forming coupler 7-chloro-6-(1,1-dimethylethyl)-3-[3-(dodecylsulfonyl)propyl]-1H-pyrazolo[5,1 -c]-1,2,4-triazole (0.318 g/m$^2$) in di-n-butylphthalate coupler solvent and gelatin. The emulsion (0.102 g Ag/m$^2$) was coated on a resin coated paper support and an overcoat applied as a protective layer along with the hardener bis (vinylsulfonyl) methyl ether as in Example 1. The emulsions were coated, and the coatings stored, exposed and processed as for the previous examples.

TABLE III

| | mg Ag mol | | Fresh | 1 week 100 vs 0° F. | 2 week 120 vs 0° F. |
|---|---|---|---|---|---|
| Sample | 1 | IIc | SPEED | Δ DMIN | Δ DMIN |
| 8 (comparison) | 0 | 0 | 190 | 0.083 | 0.469 |
| 9 (comparison) | 0 | 375 | 191 | 0.076 | 0.457 |
| 0 (comparison) | 24 | 0 | 182 | 0.058 | 0.382 |
| 1 (comparison) | 30 | 0 | 165 | 0.054 | 0.364 |
| 2 (comparison) | 40 | 0 | 151 | 0.046 | 0.342 |
| 3 (comparison) | 50 | 0 | 134 | 0.042 | 0.322 |
| 4 (comparison) | 75 | 0 | 125 | 0.033 | 0.303 |
| 35 (invention) | 24 | 120 | 192 | 0.049 | 0.298 |
| 36 (invention) | 30 | 150 | 189 | 0.043 | 0.282 |
| 37 (invention) | 40 | 200 | 183 | 0.040 | 0.266 |
| 38 (invention) | 50 | 250 | 176 | 0.035 | 0.222 |
| 39 (invention) | 75 | 375 | 155 | 0.030 | 0.176 |

It can be seen in Table III that the antifogging benefits of the combination of compounds of the present invention (samples 34–37) apply equally well to a green sensitized chloride emulsion. These inventive coatings have much less decrease in sensitivity (speed) as do those (samples 30–34) that contain only compound I.

The invention has been described in detail with particular reference to the preferred embodiments thereof, but it will be understood that variations and modifications can be effected within the scope of the invention.

What is claimed is:

1. A silver halide photographic element comprising a silver halide emulsion which is greater than 50 mole % silver chloride, said emulsion being in reactive association with a dithiolone 1-oxide compound represented by the following formula:

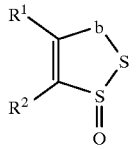

wherein b is C(O), C(S), C(Se), $CH_2$ or $(CH_2)_2$, and $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system; and a sulfinate compound.

2. The silver halide photographic element of claim 1 wherein b is C(O), C(S) or C(Se).

3. The silver halide photographic element of claim 2 wherein $R^1$ and $R^2$ together represent the atoms necessary to form a five or six-membered ring or a multiple ring system.

4. The silver halide photographic element of claim 3 wherein $R^1$ and $R^2$ together represent the atoms necessary to form a five or six-membered ring and b is C(O).

5. The silver halide photographic element of claim 4 wherein the dithiolone compound is 3H-1,2-benzodithiol-3-one 1-oxide.

6. The silver halide photographic element of claim 1 wherein the silver halide emulsion is greater than 90 mole % silver chloride.

7. The silver halide photographic element of claim 1 wherein the concentration of the dithiolone compound is from 0.1 to 1000 mg/mol Ag.

8. The silver halide photographic element of claim 1 wherein the sulfinate compound is of the formula $RSO_2M$ wherein R is a substituted or unsubstituted alkyl, aryl, or aralkyl group; and M is a monovalent metal or a tetraalkylammonium cation.

9. The silver halide photographic element of claim 8 wherein R is a substituted or unsubstituted aryl group.

10. The silver halide photographic element of claim 8 wherein M is sodium.

11. The silver halide photographic element of claim 9 wherein the sulfinate compound is sodium p-toluene sulfinate.

12. The silver halide photographic element of claim 1 wherein the concentration of the sulfinate compound is from 0.1 to 100 mg/mol Ag.

13. A silver halide photographic element comprising a silver halide emulsion which is greater than 90 mole % silver chloride, said emulsion being in reactive association with a dithiolone 1-oxide compound represented by the following formula:

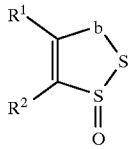

wherein b is C(O), C(S), C(Se), $CH_2$ or $(CH_2)_2$, and $R^1$ and $R^2$ together represent the atoms necessary to form a five or six-membered ring or a multiple ring system; and a sulfinate compound of the formula $RSO_2M$ wherein R is an alkyl, aryl, or aralkyl group; and M is a monovalent metal or a tetraalkylammonium cation.

14. The silver halide photographic element of claim 13 wherein the concentration of the dithiolone compound is from 0.1 to 1000 mg/mol Ag and the concentration of the sulfinate compound is from 0.1 to 100 mg/mol Ag.

15. The silver halide photographic element of claim 13 wherein R is aryl group substituted with a halogen atom or an alkyl or alkoxy group and M is sodium.

16. The silver halide photographic element of claim 13 wherein the dithiolone compound is 3H-1,2-benzodithiol-3-one 1-oxide and the sulfinate compound is sodium p-toluene sulfinate.

17. A method of making a silver halide emulsion, the emulsion being greater than 50 mole % silver chloride, comprising precipitating and chemically sensitizing the emulsion; and further comprising adding to the emulsion a dithiolone 1-oxide compound represented by the following formula:

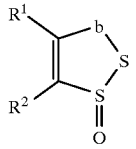

wherein b is C(O), C(S), C(Se), $CH_2$ or $(CH_2)_2$, and $R^1$ and $R^2$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, sulfo groups, or amino groups, or $R^1$ and $R^2$ together represent the atoms necessary to form a five or six-membered ring or a multiple ring system; and a sulfinate compound.

18. The method of claim 17 wherein the dithiolone compound and the sulfinate compound are added during chemical sensitization of the emulsion.

19. The method of claim 18 wherein b is C(O), C(S), C(Se); and $R^1$ and $R^2$ together represent the atoms necessary to form a five or six-membered ring or a multiple ring system; and the sulfinate compound is of the formula $RSO_2M$ wherein R is an alkyl, aryl, or aralkyl group; and M is a monovalent metal or a tetraalkylammonium cation.

20. The silver halide photographic element of claim 17 wherein the silver halide emulsion is greater than 90 mole % silver chloride; the concentration of the dithiolone compound is from 0.1 to 1000 mg/mol Ag; and the concentration of the sulfinate compound is from 0.1 to 100 mg/mol Ag.

* * * * *